US005398709A

United States Patent [19]

Lee

[11] Patent Number: 5,398,709

[45] Date of Patent: Mar. 21, 1995

[54] SUNSHADE

[75] Inventor: Shihhsie Lee, Chang-Hua, Taiwan, Prov. of China

[73] Assignee: Jong-Chang Huang, Chang-Hua, Taiwan, Prov. of China

[21] Appl. No.: 277,821

[22] Filed: Jul. 20, 1994

[51] Int. Cl.[6] ..... A45B 25/06

[52] U.S. Cl. ..... 135/28; 135/39; 248/295.1; 248/297.2; 403/324; 403/327

[58] Field of Search ..... 135/15.1, 28, 25.33, 135/38, 39, 41, 40, 42; 248/295.1, 297.2; 403/109, 322, 324, 327

[56] References Cited

U.S. PATENT DOCUMENTS

| | | | |
|---|---|---|---|
| 180,710 | 8/1876 | Frost | 135/39 |
| 3,856,032 | 12/1974 | Schafer | 135/28 |
| 5,184,639 | 2/1993 | Lee | 135/39 X |
| 5,287,869 | 2/1994 | Wu | 135/40 X |

FOREIGN PATENT DOCUMENTS

| | | | |
|---|---|---|---|
| 1108328 | 4/1968 | United Kingdom | 135/38 |

*Primary Examiner*—Lanna Mai

*Attorney, Agent, or Firm*—Lowe, Price, LeBlanc and Becker

[57] ABSTRACT

A sunshade includes an upright post with a runner sleeved slidably thereon so as to be movable to a stretching position for operating a rib assembly in order to stretch collapsibly a top cloth above the upright post. The upright post has a spring-loaded stopper which protrudes radially to retain the rib assembly at the stretching position. The runner has an axially extending groove formed in an inner surface thereof and aligned with the stopper, and a projection formed in the groove. The projection has an upper face which inclines inwardly and downwardly and a lower face which extends radially toward the post. The runner has a releasing unit mounted thereon. The releasing unit is constituted by a pressing member which is radially movably disposed in the groove immediately under the projection and a button member which is formed integrally with the pressing member. The button member protrudes out of the runner via a through-hole in the runner.

3 Claims, 7 Drawing Sheets

SUNSHADE

BACKGROUND OF THE INVENTION

1. Field of the Invention

The invention relates to a sunshade, more particularly to a sunshade with an upright post and which is suitable for outdoor use so as to provide a temporary shade.

2. DESCRIPTION OF THE RELATED ART

FIG. 1 shows a conventional sunshade of the type which is generally used in beaches and during picnics. As illustrated, the conventional sunshade includes an upright post 10, a rib assembly 13 mounted collapsibly at a top end of the upright post 10 and a runner 11 sleeved slidingly on the upright post 10. The upright post 10 is formed with a plurality of radial through-holes 100. The rib assembly 13 includes a plurality of upper ribs 131 and a plurality of lower ribs 12 which respectively have a first end pivoted to a respective one of the upper ribs 131 at an intermediate portion thereof and a second end pivoted to the runner 11. A locking pin 14 is attached to the runner 11 by means of chains. After the runner 11 is moved axially along the upright post 10 to a position to stretch collapsibly a top cloth 130 above the upper ribs 131 of the rib assembly 13, the locking pin 14 is inserted into the corresponding through-hole 100, thereby retaining the rib assembly 13 at the stretched position to provide a temporary shade.

In order to open the conventional sunshade 1, the rib assembly 13 must be pushed upward by the runner 11 so as to stretch the rib assembly 13 and consequently, the top cloth 130 above the latter. After the rib assembly 13 has been opened to a desired height, the rib assembly 13 is retained temporarily thereat by the use of one hand, while the locking pin 14 is inserted into a corresponding through-hole 100 of the upright post 10 with the use of the other hand. Since the conventional sunshade 1 is relatively large and heavy, it is inconvenient and difficult to retain the rib assembly 13 at the desired height with the use of only one hand.

SUMMARY OF THE INVENTION

A main object of the present invention is to provide a sunshade of the above-mentioned type which can be opened more easily when compared to the conventional sunshade.

A second object of the present invention is to provide a sunshade which obviates the need to retain temporarily the rib assembly of the sunshade when opening the sunshade to a stretched position.

Accordingly, the sunshade of the present invention includes an upright post with a runner sleeved slidably thereon so as to be movable to a stretching position for operating a rib assembly in order to stretch collapsibly a top cloth above the upright post. The upright post has a spring-loaded stopper which protrudes radially therefrom so as to retain the runner at a desired height on the upright post. The runner has an axially extending groove which is formed in an inner surface thereof and which is aligned with the stopper, and a projection which is formed in the groove. The projection has an upper face which inclines inwardly and downwardly, and a lower face which extends radially toward the upright post. The runner further has a releasing means mounted thereon. The releasing means comprises a pressing member which is disposed in the groove of the runner immediately under the projection, and a button member which is integral with the pressing member. The pressing member is movable radially in the runner so that the button member can protrudes radially out of the runner via a through-hole in the latter.

In one disclosed embodiment, the upright post is constituted by an upper post, a lower post and a middle post. The middle post is a hollow pipe with a row of radial holes which are aligned axially with one another. The middle post has a core bar fixed therein. The core bar has an axially extending groove which opens radially in a direction similar to that of the radial holes of the middle post. The spring-loaded stopper is constituted by a plurality of compression springs loaded respectively in the groove of the core bar, and an elongated plate with a row of protrusion which are aligned longitudinally with one another. The elongated plate is mounted in the groove of the core bar so as to be biased by the compression springs to extend the protrusions out of the radial holes and align the protrusions with the groove of the runner. Each of the protrusions of the elongated plate has an upper face which extends radially and outwardly from the elongated plate and which forms an end, and a lower face which extends downwardly and inwardly from the end of the upper face.

When opening the sunshade of the present invention, the rib assembly is pushed upward by the runner. Since the runner is retained by the spring-loaded stopper, the rib assembly can be retained stationarily. Thus, the action of retaining temporarily the rib assembly of the sunshade of the present invention at a certain stretched position after moving the runner is eliminated.

BRIEF DESCRIPTION OF THE DRAWINGS

Other features and advantages of the present invention will become more apparent in the following detailed description of the preferred embodiments with reference to the accompanying drawings, in which.

DETAILED DESCRIPTION OF THE PREFERRED EMBODIMENT

Figure 1:
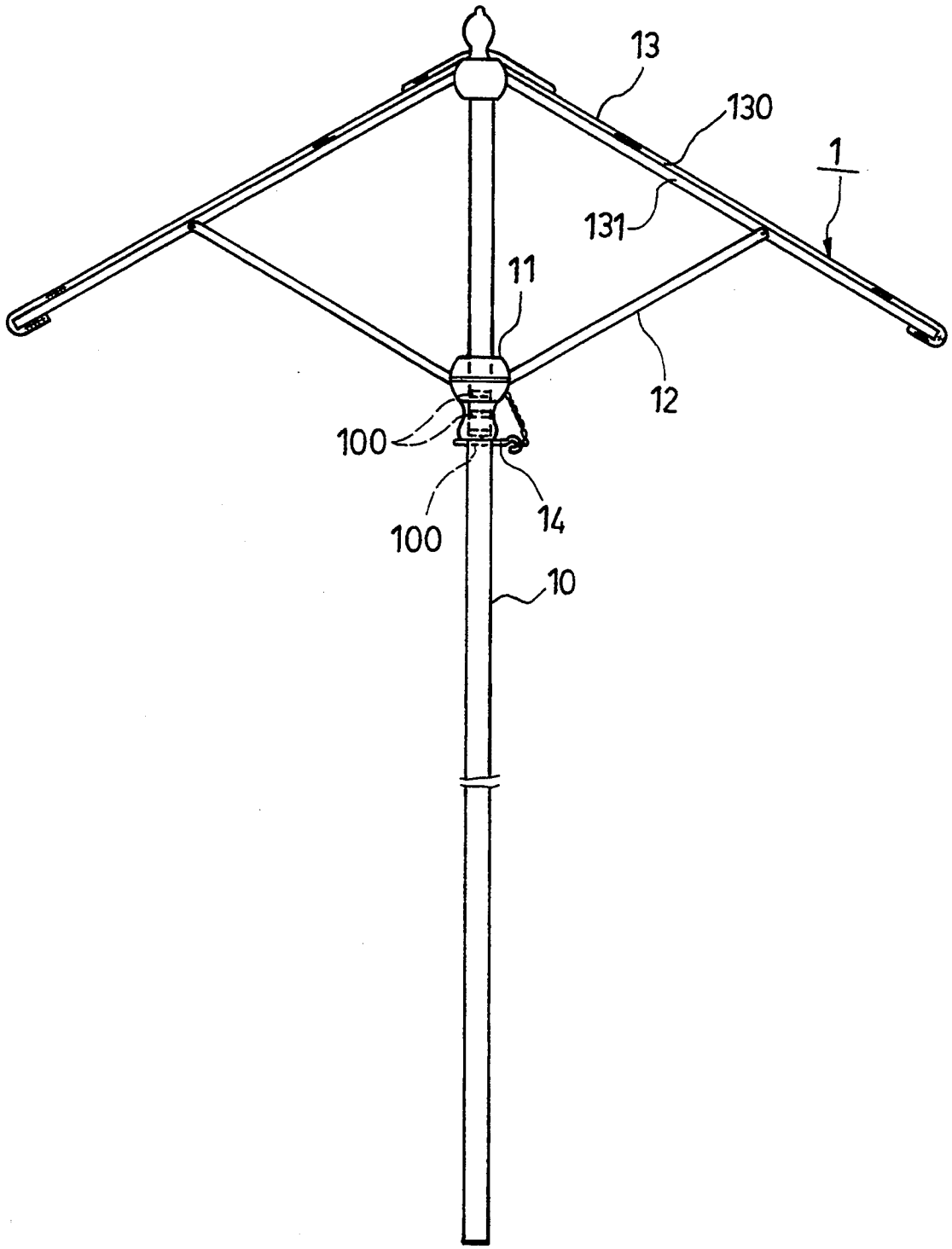
FIG.1 PRIOR ART
FIG. 1 shows a conventional sunshade.
Figure 2:
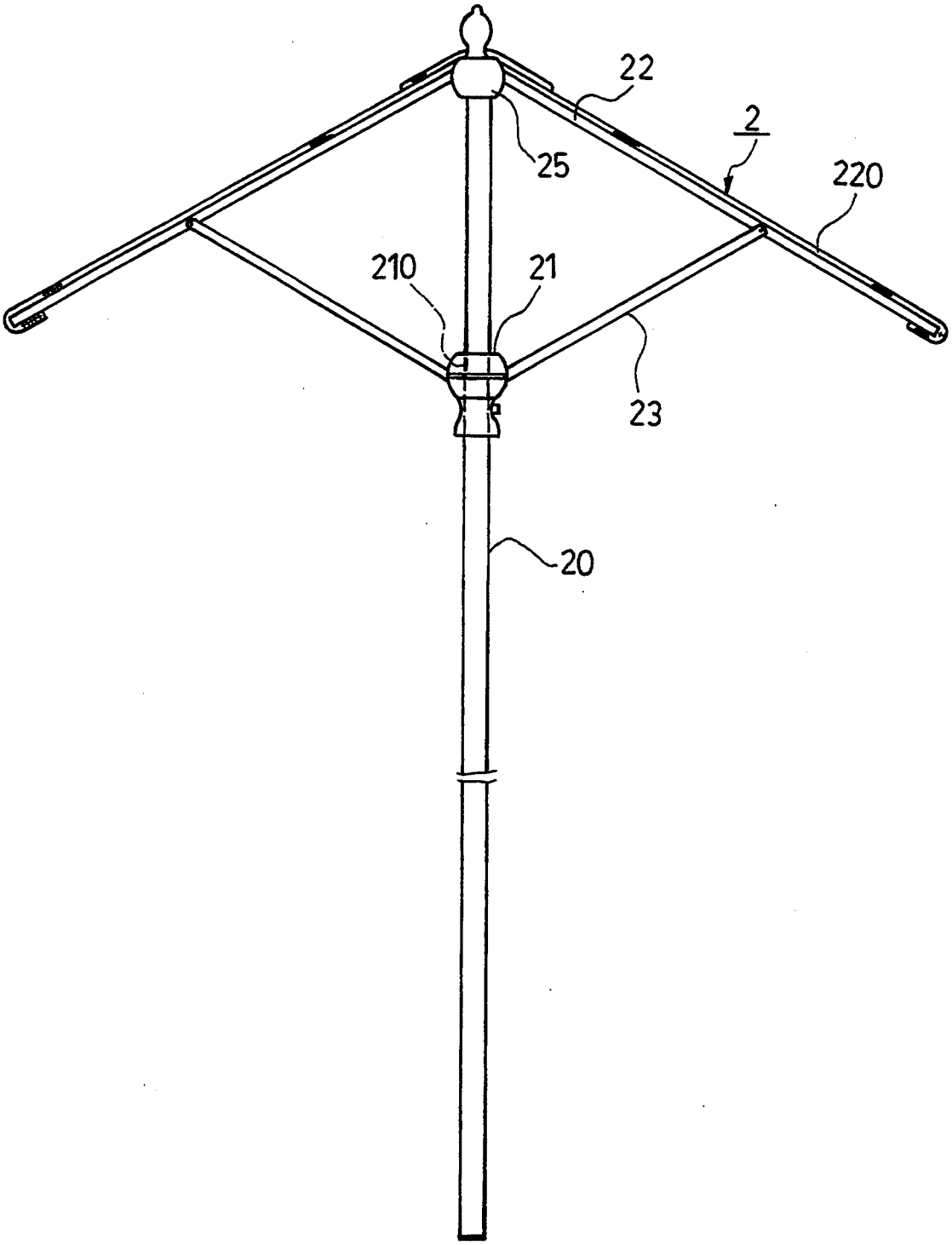
FIG. 2 shows a first preferred embodiment of a sunshade of the present invention when in a stretched position.
Figure 3:
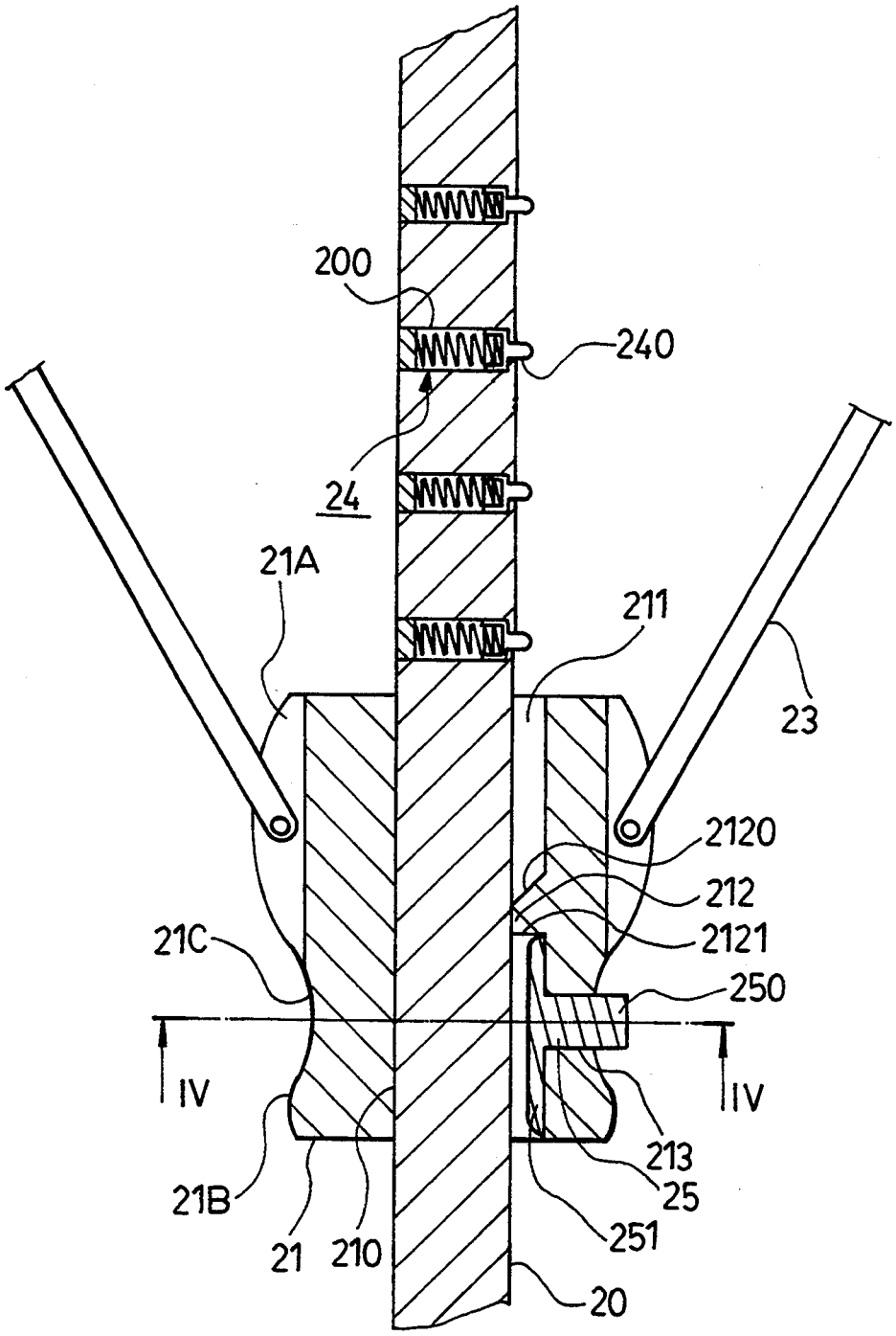
FIG. 3 shows a partially cross sectional view of the first preferred embodiment.

Referring to FIG. 2, a first preferred embodiment of a sunshade 2 of the prevention is shown to comprise an upright post 20 with a runner 21 sleeved slidably thereon and a rib assembly mounted at the top end thereof. The rib assembly includes a plurality of upper ribs 22 with upper ends that are held together by means of a tubular sleeve 25 which is mounted securely to the top end of the upright post 20, and a plurality of lower ribs 23 with lower ends that are connected pivotally to the runner 21. The upper ends of the lower ribs 23 are connected pivotally to the upper ribs 22 at the intermediate sections of the latter. A top cloth 220, generally made of a light, opaque and water-impermeable material such as tarpaulin, is stretched over the upper ribs 22 of the rib assembly. As illustrated in FIG. 3, the runner 21 is a substantially tubular-shaped member with an enlarged upper portion 21A, a lower portion 21B, a constricted middle portion 21C and an inner face with an axially extending groove 211 that confines a through hole 210 via which the upright post 20 extends therethrough. The constricted middle portion 21C of the runner 21 is provided with a radial through hole 213 which is communicated with the axial groove 211. The inner face of the runner 21 has a projection 212 in the axial groove 211 of the same. The projection 212 is formed with an upper face 2120 that inclines inwardly and downwardly and a lower face 2121 that extends radially toward the upright post 20. The upright post 20 has a spring-loaded stopper 24 which is formed by four axially aligned blind holes 200 and four protrusions 240 that protrude retractably and radially from the blind holes 200 to engage the projection 212 so as to retain the runner 21 at a certain position during the normal conditions. The runner 21 is provided a releasing means 25. The releasing means 25 is a one-piece molded unit and comprises a pressing member 251 which is disposed immediately under the projection 212 and which is movable radially in the axial groove 211, and a button member 250 which is formed integrally with the pressing member 251. The button member 250 protrudes radially out of the runner 21 via the through-hole 213.

Figure 4:
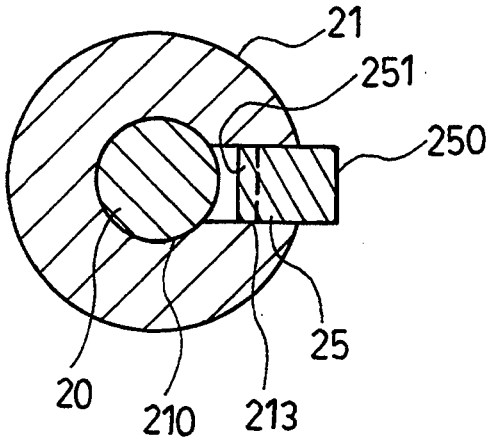
FIG. 4 illustrates a cross sectional view of a runner employed in the first preferred embodiment, taken along the line IV—IV in FIG. 3.
Figure 5:
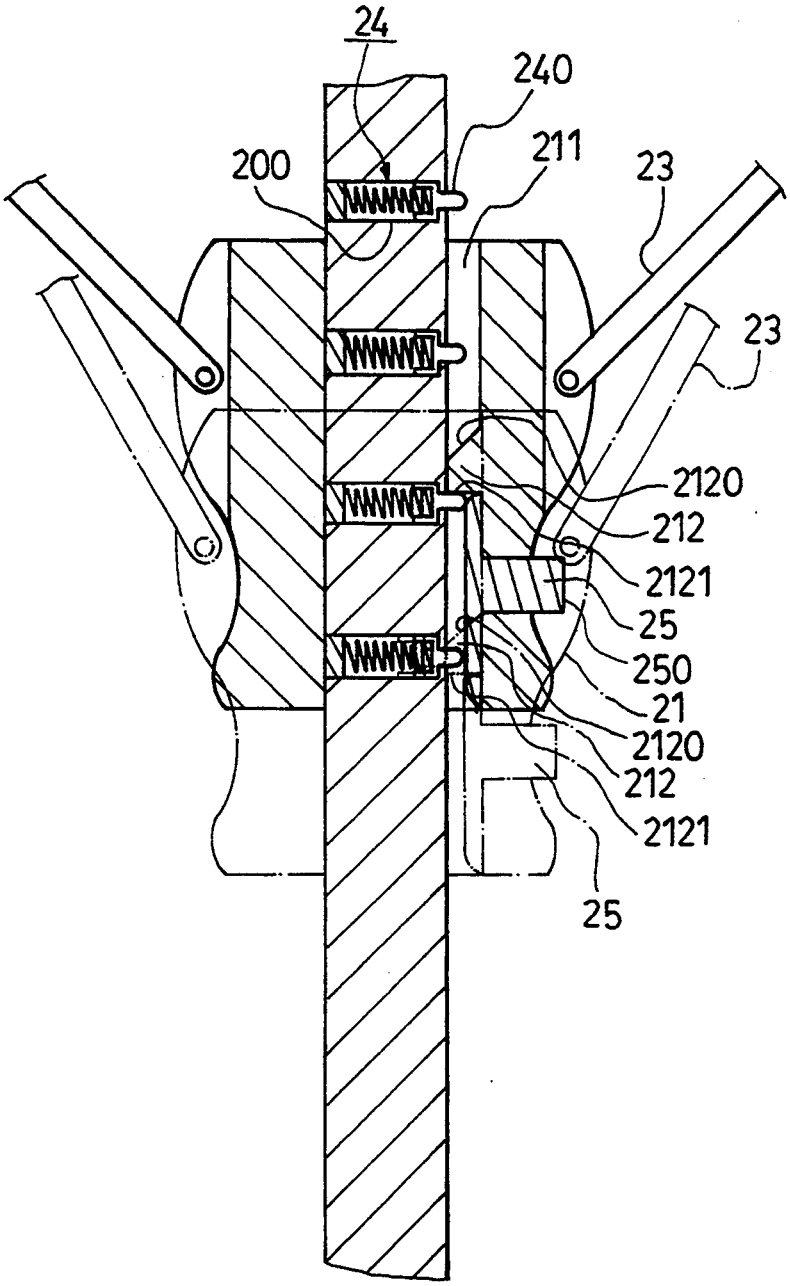
FIG. 5 illustrates the relationship between the runner and a spring-loaded stopper of the first preferred embodiment.

Referring to FIGS. 4 and 5, when it is desired to fold the sunshade of the present invention, the button member 250 is pressed to cause a respective one of the protrusions 240 to retract interiorly of the upright post 20, thus resulting in the release of the protrusion 240 from the projection 212 so that the runner 21 can move downwardly relative to the upright post 20. Each free end of the protrusions 240 is rounded to permit smooth sliding thereof along the upper face 2120 of the ]projection 212 when the latter slides in the upward direction.

Figure 6:
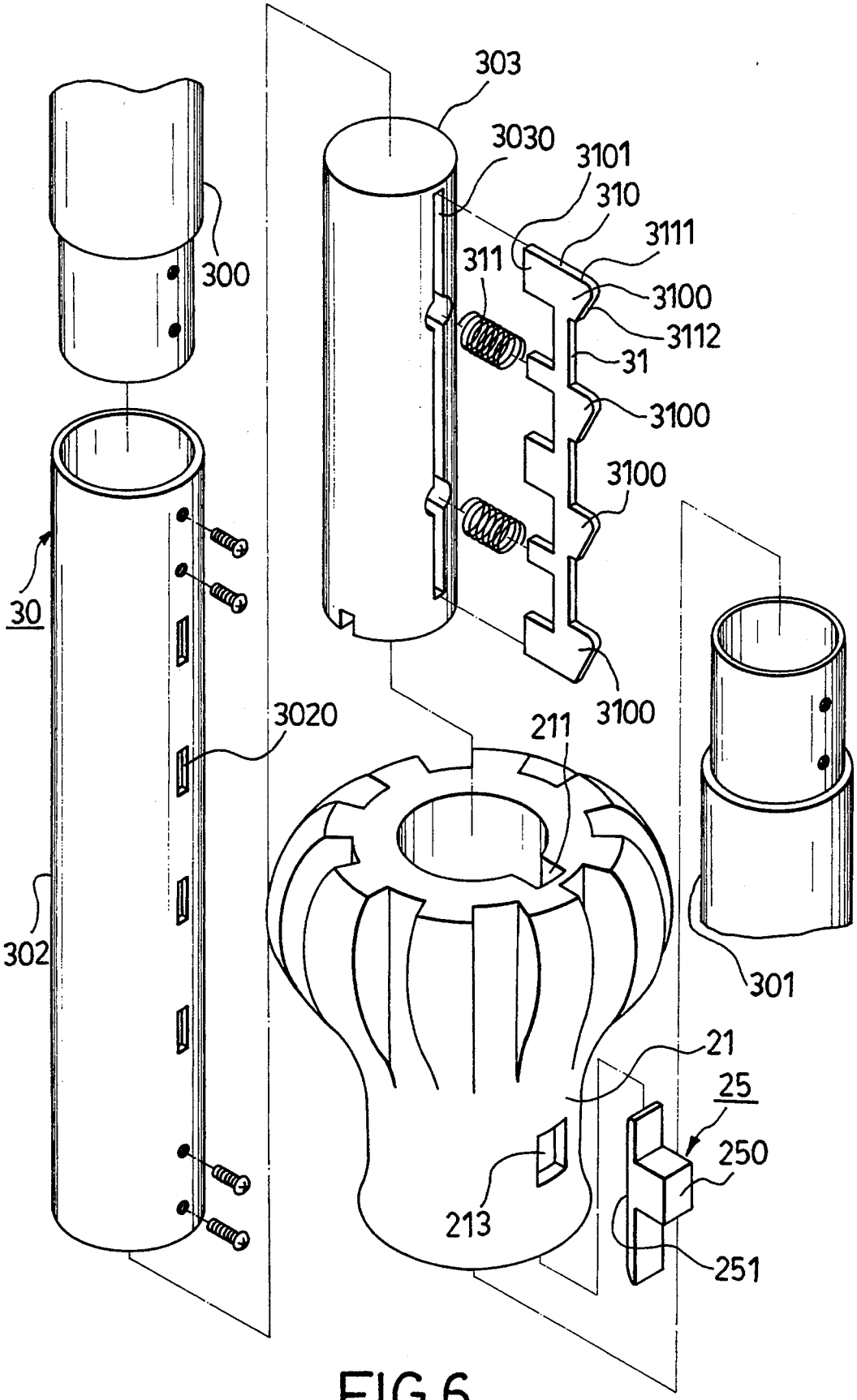
FIG. 6 shows an exploded view of a second preferred embodiment of the sunshade of the present invention.
Figure 7:
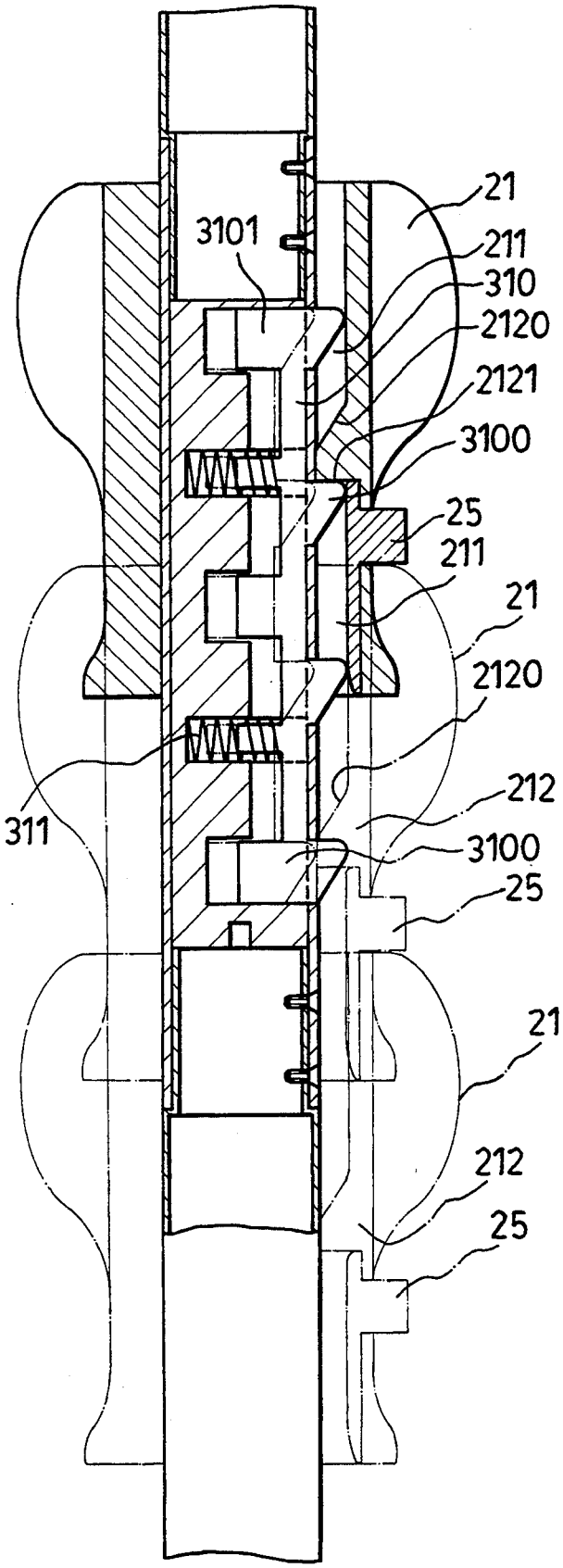
FIG. 7 illustrates the relationship between the runner and the spring-loaded stopper of in the second preferred embodiment.

Referring to FIGS. 6 and 7, in a second preferred embodiment of this invention, the upright post 30 comprises an upper post 300 and a lower post 301 mounted respectively to two ends of a middle post 302 by means of screws. The middle post 302 is a hollow pipe with four radial holes 3020 which are aligned axially with one another. The middle post 302 has a core bar 303 fixed therein. The core bar 303 has an axially extending groove 3030 which opens radially in a direction similar to that of the radial holes 3020 of the middle post 302. The spring-loaded stopper is constituted by two compression springs 311 loaded respectively in the groove 3030 of the core bar 303, and an elongated plate 310 with four protrusions 3101 that are aligned longitudinally with one another. The elongated plate 310 is mounted in the groove 3030 of the core bar 303 so as to be biased by the compression springs 311 to protrude the protrusions 3100 out of the radial holes 3020 and align the protrusions 3100 with the groove 211 of the runner 21.

To facilitate engagement of the protrusions 3100 of the elongated plate 310 with the projection 212 of the runner, each one of the protrusions 3100 is provided with an upper face 3111 which extends radially and outwardly from the elongated plate 310, and a lower face 3112 which extends downwardly and inwardly from one end of the upper face 3111. The releasing means employed in this embodiment is the same as that of the previous embodiment.

It is noted that, when stretching the rib assembly 22 of the sunshade of the present invention, there is no need to retain temporarily the rib assembly 22 with the use of one hand. Instead, the rib assembly 22 is pushed upwardly by the runner 21 along the upright post 20. During the upright movement of the runner, the upper face 2120 of the projection 212 slides past the spring-loaded stopper which immediately and radially protrudes to retain the projection 212. Thus, the sunshade of the present invention is more convenient to use when compared to the previously described sunshade.

While preferred embodiments have been described and explained, it will be apparent that many changes and modifications can be made in the general construction and arrangement without departing from the scope and spirit thereof. It is therefore desired that the present invention be not limited to the exact disclosure but only to the extent of the appended claims.

I claim:

1. A sunshade including an upright post with a runner sleeved slidably thereon so as to be movable to a stretching position for operating a rib assembly in order to stretch collapsibly a top cloth above said upright post, said sunshade being characterized by:

said post having a spring-loaded stopper protruding radially therefrom so as to retain said runner at the stretching position; and said runner having an axially extending groove formed in an inner surface thereof and aligned with said stopper, and a projection formed in said groove, said projection having an upper face which inclines inwardly and downwardly and a lower face which extends radially toward said post, said runner further having a releasing means mounted thereon, said releasing means including a pressing member which is radially movably disposed in said groove immediately under said projection and a button member which is integral with said pressing member and which protrudes radially out of said runner via a through-hole in said runner.

2. The sunshade as defined in claim 1, wherein said post is constituted by an upper post, a lower post and a middle post, said middle post being a hollow pipe with a row of axially aligned radial holes and a core bar fixed therein, said core bar having an axially extending groove opening radially in a direction similar to that of said radial holes of said middle post, said spring-loaded stopper being constituted by a plurality of compression springs loaded respectively in said groove of said core bar and an elongated plate with a row of longitudinally aligned protrusions, said elongated plate being mounted in said groove of said core bar so as to be biased by said compression springs to extend said protrusions thereof out of said radial holes and align said protrusions with said groove of said runner.

3. The sunshade as defined in claim 2, wherein each one of said protrusions of said elongated plate has an upper face extending radially and outwardly from said elongated plate and forming an end, and a lower face extending downwardly and inwardly from said end of said upper face.

* * * * *